US005656819A

United States Patent [19]

Greenly

[11] Patent Number: 5,656,819

[45] Date of Patent: Aug. 12, 1997

[54] PULSED ION BEAM SOURCE

[75] Inventor: John B. Greenly, Lansing, N.Y.

[73] Assignee: Sandia Corporation, Albuquerque, N. Mex.

[21] Appl. No.: 657,727

[22] Filed: May 30, 1996

Related U.S. Application Data

[63] Continuation-in-part of Ser. No. 340,519, Nov. 16, 1994, Pat. No. 5,525,805 .

[51] Int. Cl.[6] ..... H01J 27/00

[52] U.S. Cl. ..... 250/423 R; 315/111.41

[58] Field of Search ..... 250/423 R, 424; 315/111.21, 111.41, 111.71, 111.81; 313/231.31, 231.61

[56] References Cited

U.S. PATENT DOCUMENTS 4,707,637 11/1987 Harvey ..... 250/423 R 4,721,889 1/1988 Seidel et al. ..... 250/423 R 5,525,805 6/1996 Greenly ..... 250/423 R

*Primary Examiner*—Jack I. Berman

*Assistant Examiner*—Kiet T. Nguyen

*Attorney, Agent, or Firm*—Gregory A. Cone

[57] ABSTRACT

An improved pulsed ion beam source having a new biasing circuit for the fast magnetic field. This circuit provides for an initial negative bias for the field created by the fast coils in the ion beam source which pre-ionize the gas in the source, ionize the gas and deliver the gas to the proper position in the accelerating gap between the anode and cathode assemblies in the ion beam source. The initial negative bias improves the interaction between the location of the nulls in the composite magnetic field in the ion beam source and the position of the gas for pre-ionization and ionization into the plasma as well as final positioning of the plasma in the accelerating gap. Improvements to the construction of the flux excluders in the anode assembly are also accomplished by fabricating them as layered structures with a high melting point, low conductivity material on the outsides with a high conductivity material in the center.

10 Claims, 12 Drawing Sheets

MIN ψ LEV = 0.500E-01 KG*cm**2 INC = 0.100E+00

I fc = 0

MIN ψ LEV = -1.6 kg*CM**2 INC = 0.30

$I_{fc} = 0.1$

MIN Ψ LEV =-8.50 KG * cm **2 INC = 1.00

$I_{fc} = 0.5$

MIN ψ LEV = 17.50 KG* cm**2 INC = 2.00

$I_{fc} = 1.0$

MIN ψ LEV = -38.21 KG* cm**2 INC = 3.32

I fc = 2.0

MIN Ψ LEV = 0.0000E+00 KG * cm**2 INC = 0.100E+00

I fc = -0.05

MIN Ψ LEV = -0.100E+00 KG* cm**2 INC = 0.100E+00

$I_{fc} = 0.02$

MIN Ψ LEV = -0.400E+00 KG* cm**2 INC = 0.100E+00

$I_{fc} = 0.08$

PULSED ION BEAM SOURCE

This application is a continuation-in-part of U.S. patent application Ser. No. 08/340,519, filed Nov. 16, 1994, now U.S. Pat. No. 5,525,805, issued Jun 11, 1996. This patent is incorporated by reference herein in its entirety.

This invention was made with Government support under Contract DE-AC04-94AL85000 awarded by the U.S. Department of Energy. The Government has certain rights in this invention.

FIELD OF THE INVENTION

This invention relates to pulsed ion beam sources, also known as Magnetically confined Anode Plasma ion beam sources. More particularly, the invention relates to improvement made to such devices in the areas of bias circuits and the construction of the flux excluder assemblies.

BACKGROUND

As development has continued on the Magnetically-confined Anode Plasma (MAP) ion beam source, now the subject of U.S. Pat. No. 5,525,805, certain improvements have been made that are the subject the present patent application. By way of background, the MAP ion beam source, also known as the MAP ion diode or MAP diode, has been combined with a high energy, short pulse power supply to create high energy, short duration, repetitively pulsed ion beams that can be employed in several ways. Chief among them are, for metal surfaces, increased hardness, smoothness, corrosion resistance and, for polymers, increased cross-linking and toughness. The particular construction of this MAP ion diode is such that it is able to be repetitively pulsed for long periods of time and thereby have broad commercial applications. Pulsed ion sources known prior to that covered by U.S. Pat. No. 5,525,805 could not be repetitively pulsed in this fashion and suffered as well from ion beam rotation and dispersion problems caused by the configuration of their magnetic coil components.

The MAP ion diode of U.S. Pat. No. 5,525,805 and the present MAP ion beam source have many of the same construction details. An ionizable substance, typically a gas, is introduced at a point on the central axis 11 of the device through a puff valve 14 as seen in FIG. 1. This puff valve is electrically controlled to open in approximately 25–50 μsec, producing a puff of gas that arrives at a radius of 10 cm 50–150 μsec later in the evacuated interior of the device. The puff valve in the present ion beam source comprises a Belleville shape conical diaphragm 12 made of beryllium-copper that seats against 2 O-rings, not shown, and is driven open by a 6 kA, 20 μsec rise time pulse through a three turn coil 13 that flattens the diaphragm, allowing the gas trapped in the plenum between the O-rings to escape into and travels radially outwards through a passageway 14. The restoring force on the diaphragm and/or its contact with the inner anode flux excluder 16 causes it to return to the initial closed position. The passageway is designed to conduct the gas puff at supersonic speed to an ionization region 23 located behind an annular opening 24 in the anode electrode 16, 17 of the ion beam source 10. Both the anode electrodes 16, 17 and the cathode electrodes 18, 19 are disposed in radial fashion about the central axis and form an accelerating gap there between. The ionization chamber has a rear wall that contains fast magnetic coils 15. Slow magnetic coils 20 are located in the cathode electrode on each side of the annular opening 21.

The fast coils and the slow coils work together to ionize the gas into a plasma and to hold the plasma at the annular gap 24 in the anode electrode assembly 16, 17. Once the plasma is at the annular gap, the main power pulse from the pulsed power supply system is delivered to the anode electrode, and the ions in the plasma are accelerated in the accelerating gap between the anode and the cathode (held at ground) and out of the ion beam source through an annular gap 21 in the cathode electrode to interact with the material of interest, a metal or polymer surface for example. The direction of the accelerated ions is shown by the lines 22.

SUMMARY OF THE INVENTION

The basic construction of the MAP ion beam source discussed immediately above has been improved in several respects. The operation and construction of the fast coil and its driving circuits have been modified to improve the efficiency of the MAP ion beam source. The driving circuits have been adapted to allow the magnetic field from the fast coil to be biased negatively initially and then positively for the main portion of the signal in order to deliver the plasma to the annular gap in the anode electrode at the optimal time and position and also to take advantage of the interaction between a ringing field placed on the main fast coil field and the field from the slow coil to more efficiently ionize the gas. The durability of the anode electrode structures has also been improved by the substitution of different materials and layers of materials.

DETAILED DESCRIPTION OF THE INVENTION

Figure 1:
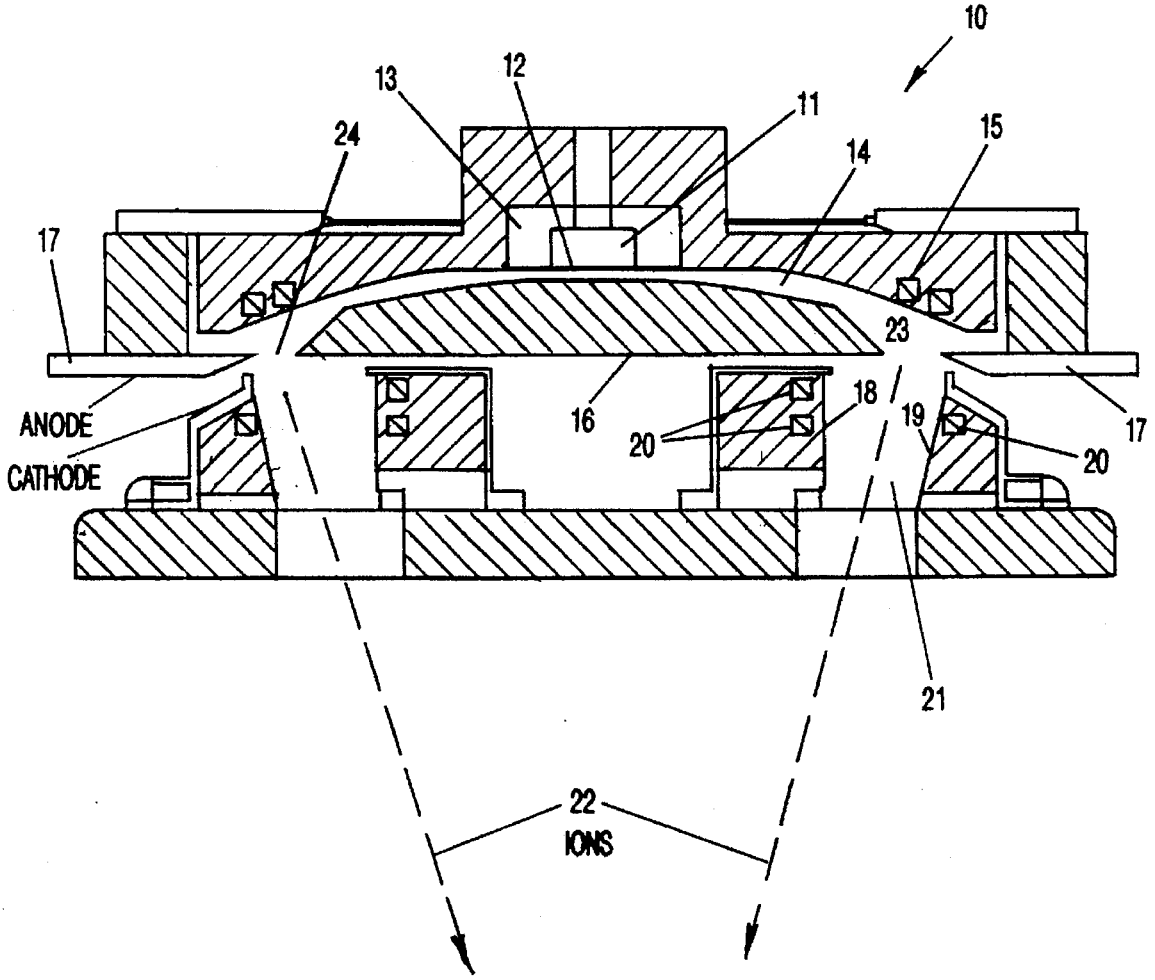
FIG. 1 is a cross-sectional view of the MAP ion beam source.

Continuing with the description of the ion beam source, the slow coils 20 are two sets of coils, one in the inner cathode assembly 18 and one in the outer cathode assembly 19, separated by the cathode annulus 21. The coils are driven in series with a 12 kA, 130 μsec rise time pulse to provide magnetic insulation for the accelerating gap between the anode assembly and the cathode assembly. The slow coils are held at ground.

The fast coil is constructed of four parallel two turn coils embedded in epoxy at 22 degrees from vertical. This angle determines the distance from the anode at which the ions come to a focus. The fast coil is driven by a 45 kA, 2 μsec rise time pulse to both ionize the gas and position the resulting plasma prior to the arrival of the main power pulse to the anode assembly. The combination of the slow and fast magnetic fields provides the basis for the operation of the ion beam source. The plasma formed by the fast field (produced by currents therein including various combinations of ringing and bias currents) is magnetically confined at the anode annulus between the inner and outer anode flux excluders. Proper field profiling and timing are essential for diode operation.

The slow magnetic field is essentially static on the time scales of the fast field and the accelerator. Aluminum inner and outer flux excluders allow only a small amount of slow field penetration while excluding the fast coil flux. These structures may be made of other materials and combinations of materials for better performance as discussed in more detail below. The plasma is vertically confined between the slow and fast fields at the annulus gap 24 in the anode assembly until the main power pulse is applied to the anode, thereby accelerating the ions in the plasma. The several plots of the magnetic fields at various times and at various fast coil current levels were generated by a widely-available computer code Diffusive-ATHETA.

The ion beam source typically operates in the following manner for a 140 μsec delay between the puff valve (pressurized to 3–30 psig operating range) and triggering of the fast coil: at time 0, the puff valve opens and supersonically delivers the gas volume to the ionizing region 23 immediately in front of the fast coil. The slow coil is triggered to produce the insulating field. The fast coil is triggered 140 μsec after the puff valve, at the peak of the slow coil, to induce an aximuthal loop voltage on the puff gas volume which ionizes the gas. The rising fast field pushes the plasma to the annular gap 24 formed between the tips of the inner 16 and outer 17 anode flux excluders (part of the anode assembly) where the plasma then stagnates against the slow magnetic field. The main power pulse is then fired 2 μsec after the fast coil to extract ions from the plasma trapped at the annulus 24. The actual accelerating gap between the anode and the cathode here ranges from about 8 to about 15 mm. The ions come to a focus or convergence at a point about 30 cm from the fast coil surface.

Since this ion beam source is designed to be used commercially, it is of primary importance that considerable energy used by the overall system be used efficiently. One area of importance is the efficient production of plasma. Inductive radio frequency breakdown of the gas is the preferred method for this system. The basic technique is known. It is necessary to bring the electrons in the gas up to 5–100 ev. These energetic electrons, accelerated by the RF electric field, create ion pairs from the gas molecules, forming the plasma. One known method to do this is to employ a ringing pre-ionizer circuit that superimposes an oscillating signal onto the main fast coil signal that is at least 5% of the magnitude of the main signal. If the fast coil current is allowed to oscillate through one or a few half-cycles before or during the early portion of the main rise of the fast field, so-called x-points in the composite magnetic field appear during the half cycles when the fast coil field is opposed to the normal direction of the main fast coil field. These x-points mark nulls in the composite magnetic field (the combined fast and slow magnetic fields) in the ionizing region 23 where all the field energy is in the electric field and electrons move primarily in the direction of the electric field without significant deflection due to the magnetic field. The electrons moving along electric field lines rapidly gain the 5–100 ev energies needed to pre-ionize the gas. Ringing a magnetic field through zero is a standard technique for accomplishing pre-ionization in theta-pinch plasma formation. However, the superposition of slow field and ringing field in the MAP source gives the new x-point configuration which determines the exact location of the ionization, and optimizes the efficiency of the ringing field in producing ionization.

Turning now to the series of magnetic field plots found in FIGS. 2A–2H, the plots are helpful to illustrate the gas breakdown and plasma dynamics effects important to the operation of the ion beam source. Note that the flux surfaces are not the same set of $\Psi$ (magnetic flux function $rA_\Phi$) values from one plot to another, but the captions under the plots give the minimum $\Psi$ value plotted (this is the surface farthest in flux value from the inner slow coil windings where $\Psi$ is a maximum) and the increment in $\Psi$ between plotted surfaces, in units of kG-cm$^2$, enabling one to count up from the minimum surface to find the $\Psi$ value at any surface. The surface tangent to the anode electrodes (as well as all other flux excluders) is of course the $\Psi$=0 surface.

Figure 2A:
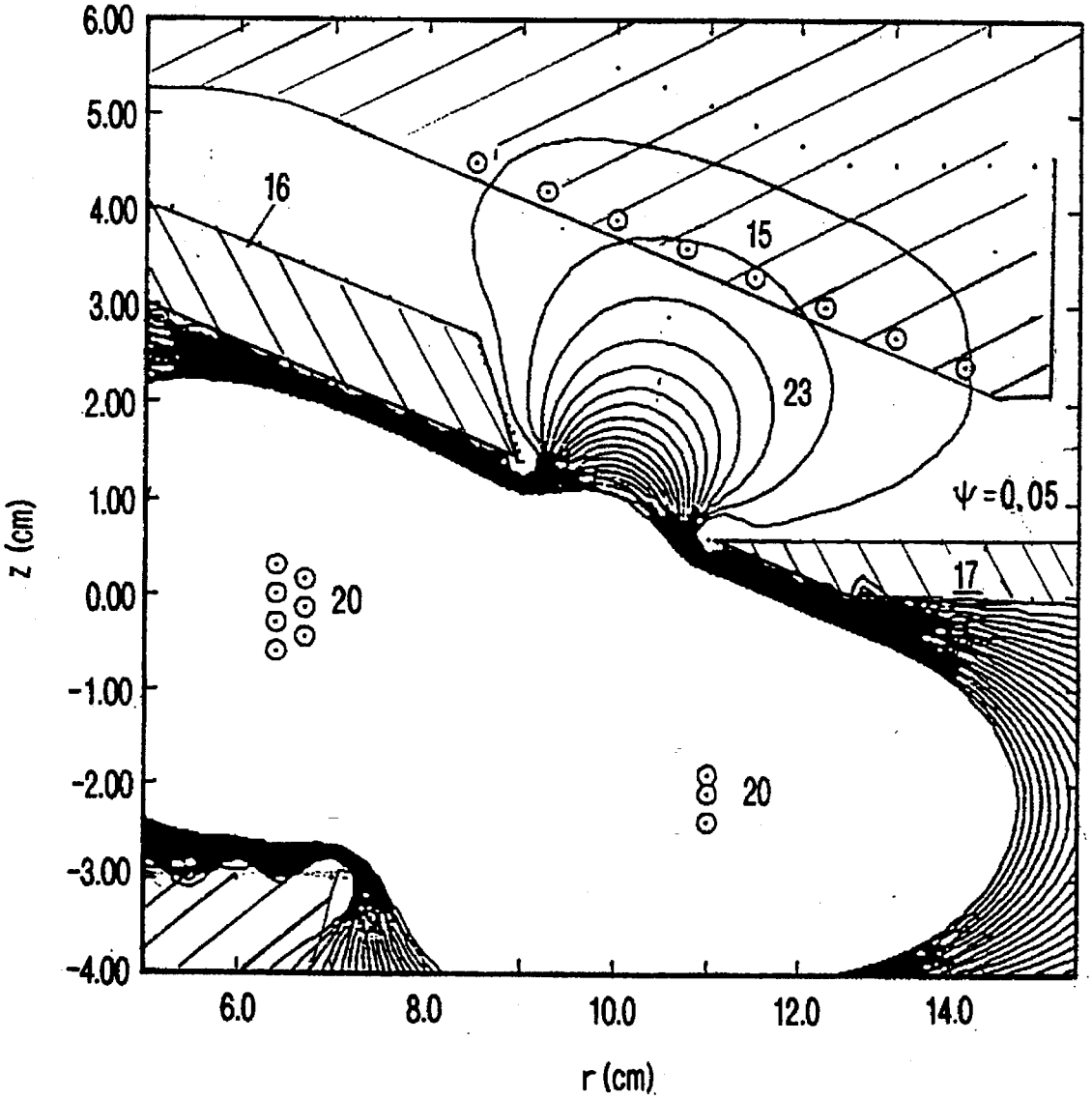
FIGS. 2A, 2B, 2C, 2D, 2E, 2F, 2G and 2H are diagrams of the magnetic field lines from the fast and slow coils at various times during a cycle of operation of the MAP ion beam source superimposed on the ionization region 23 on the right side of the cross-sectional view of FIG. 1.
Figure 2B:
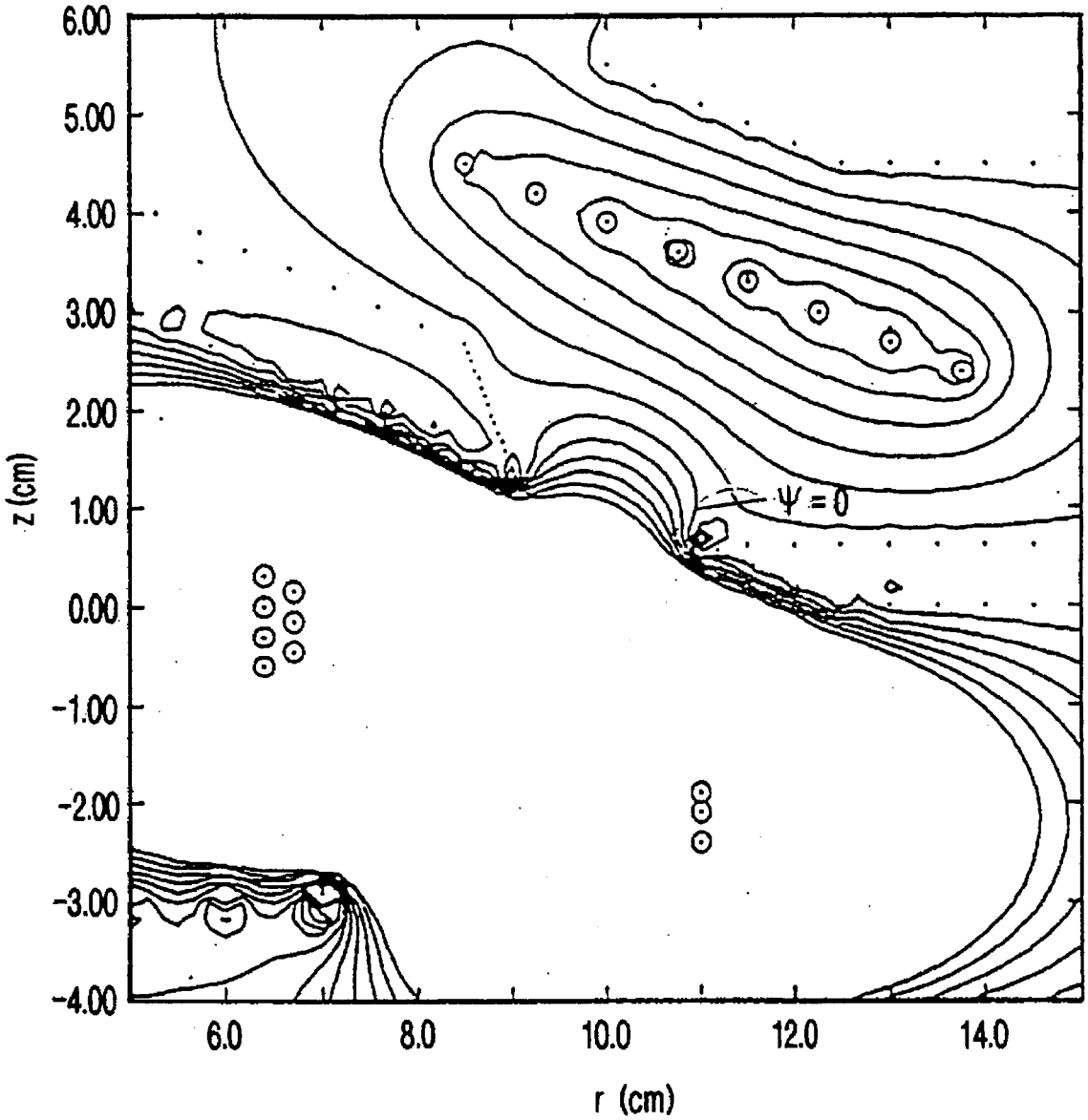
Figure 2C:
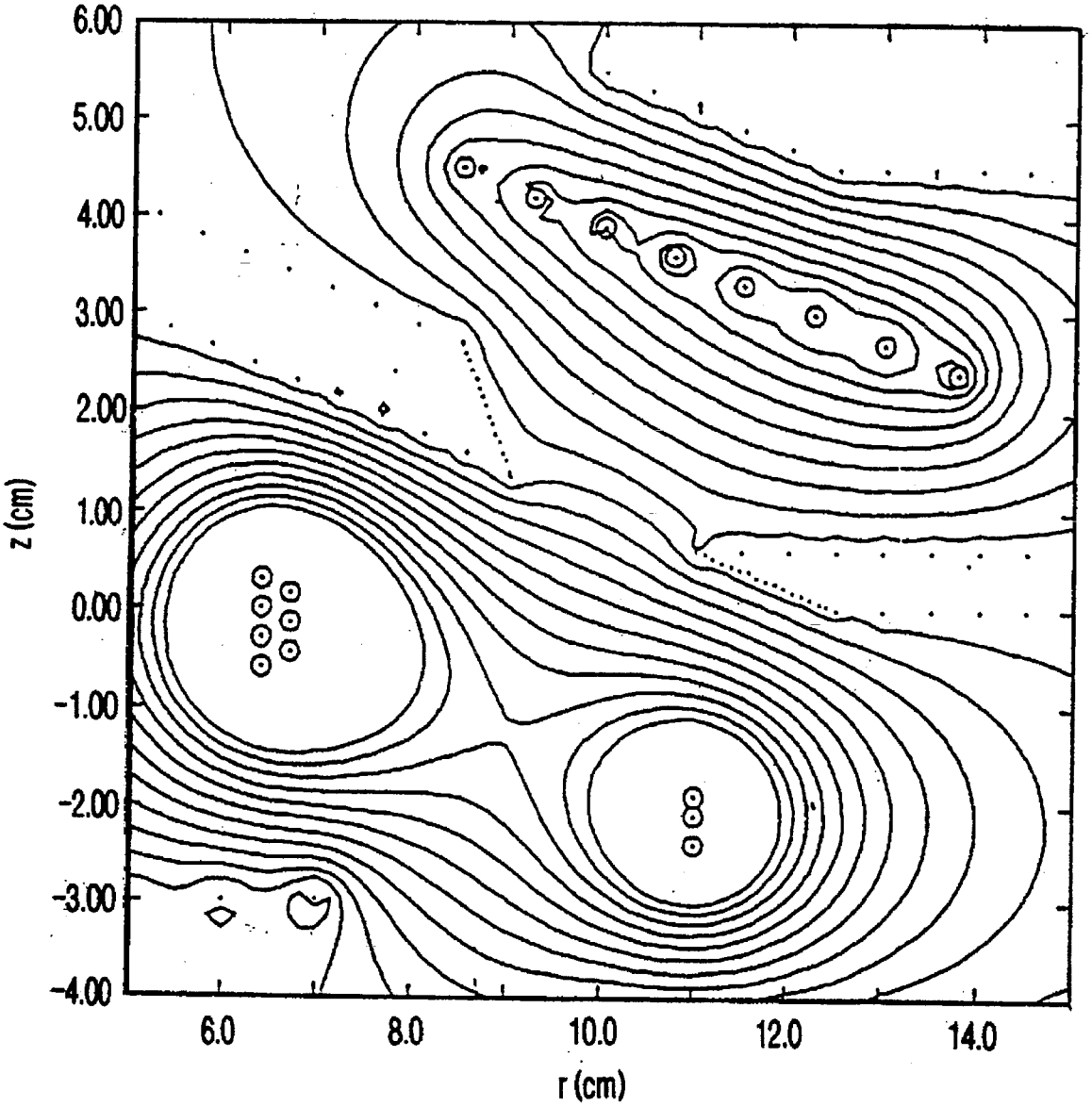
Figure 2D:
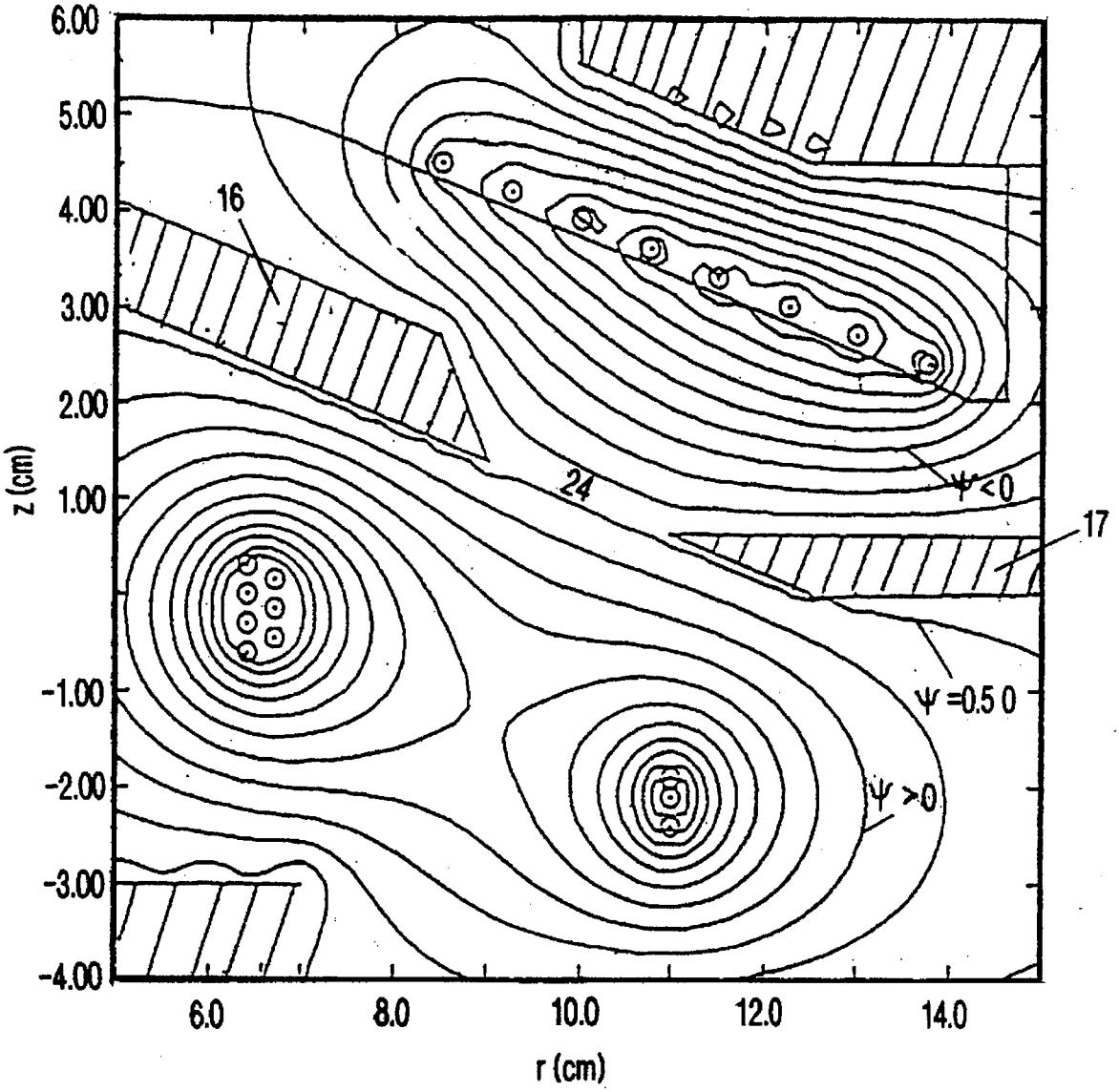

FIG. 2D shows the fields at the ideal time to fire the main power pulse. The plasma will stagnate between the outermost flux surfaces from the fast and slow coils, here located symmetrically across from each other across the anode annulus 24. The fast coil current levels in all the other plots are normalized to the this optimal value, $I_{fc}$=1. Note the preferred flatness of the $\Psi$=0.5 surface just in front of the anode electrodes. If the plasma were sitting with its edge on the $\Psi$=0 surface that connects the tips of the electrodes (not plotted because the computer code has limited numerical accuracy in this area), one could expect that a well-behaved ion beam could be extracted upon delivery of the main power pulse to the anodes. Note that the cathode assembly is not shown in any of these plots. The cathode structure affects the field shape very little, and the code cannot handle resistive elements.

Knowing the desired endpoint as shown in FIG. 2D, we now return to the start of the process where only the slow coil field is active in FIG. 2A. Here there is no fast coil field. The slow coil flux surfaces below the anode annulus have mostly been omitted here and in FIG. 2B. In FIG. 2A, note how the flux surface from the slow coil bulges past the flux excluders 16, 17 of the anode assembly into the ionization zone 23 and past the fast coil 15. Here the B field is non-zero everywhere in front of the fast coil and has a strong gradient towards the annulus 24. If one were to pulse the fast coil with gas present, breakdown is easiest adjacent the fast coil surface where the gas density is high and the initial B field is weakest and the induced E field is the strongest.

Figure 2E:
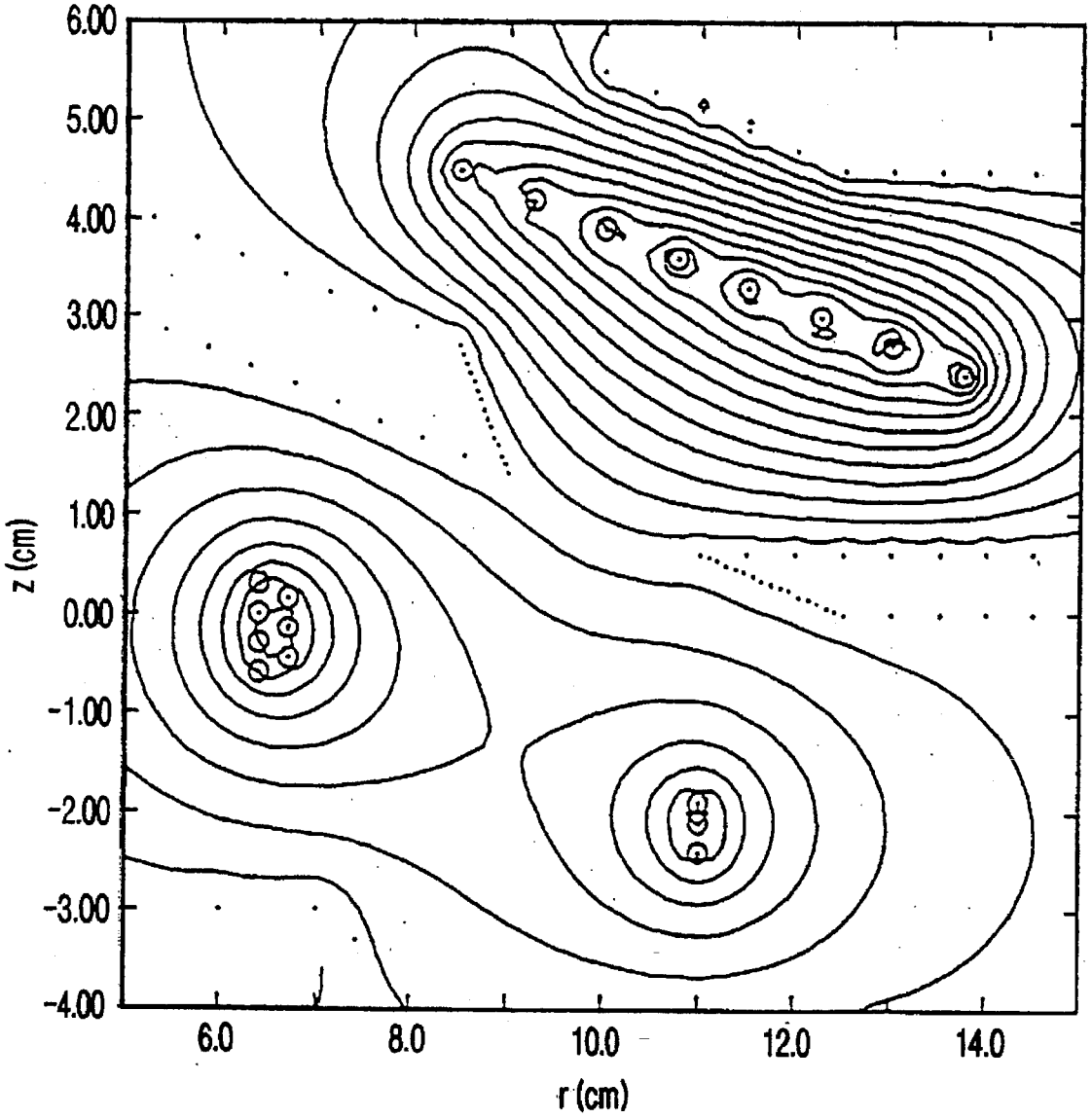

The B field evolves as the fast coil current rises as seen in plots 2A–2D, corresponding to $I_{fc}$=0, 0.1, 0.5, and 1 respectively. FIG. 2E shows what happens when the fast coil current rises past its optimum to $I_{fc}$=2.0. Starting with the first plot, one can see that the flux surfaces get pushed away from the fast coil very rapidly. By the time $I_{fc}$=0.1, the $\Psi$=0 surface is about 15 mm away from the fast coil surface. The $\Psi$=0 surface then moves progressively more slowly up to the anode location as $I_{fc}$ goes to 1.

Figure 2F:
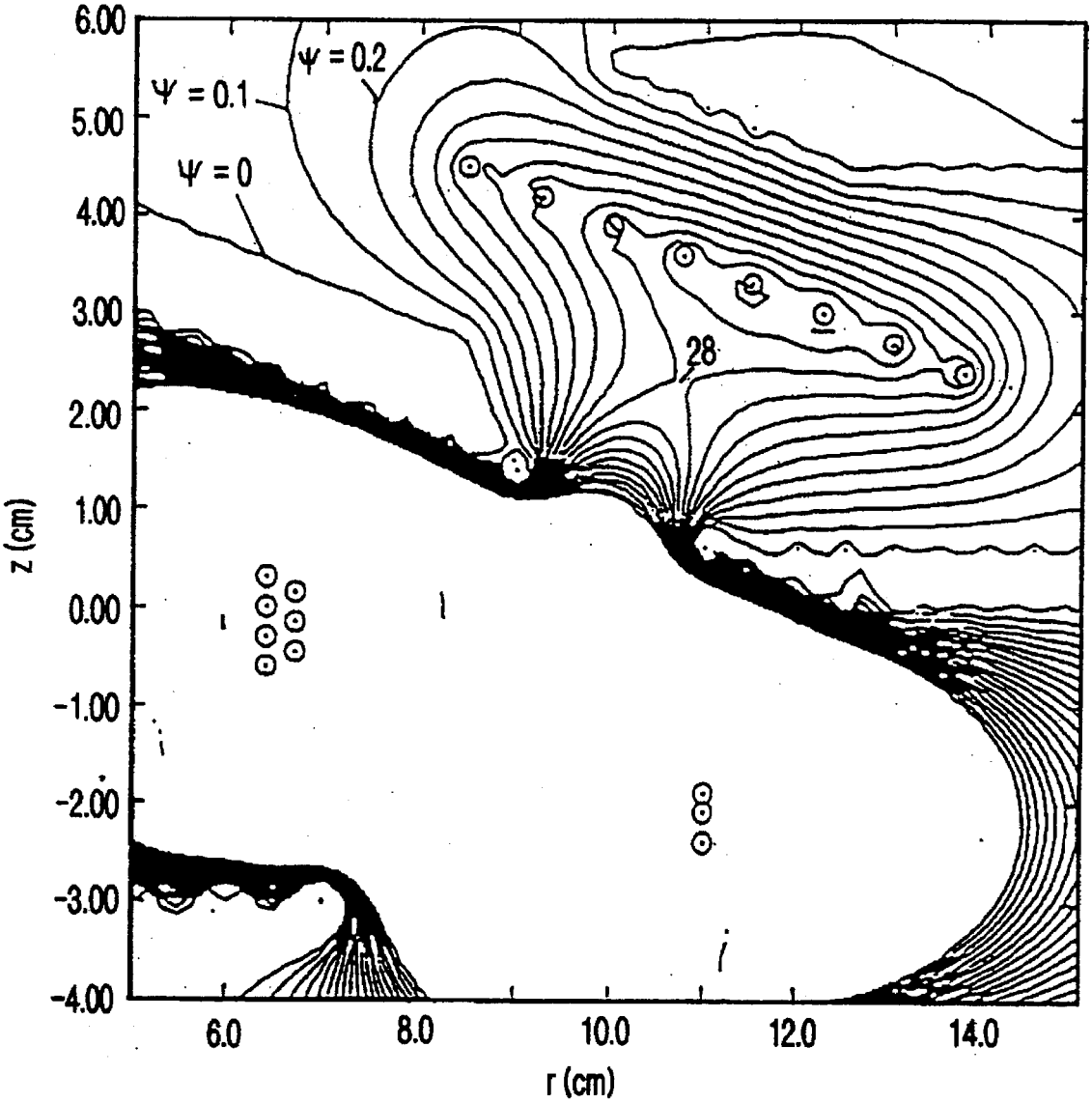
Figure 2G:
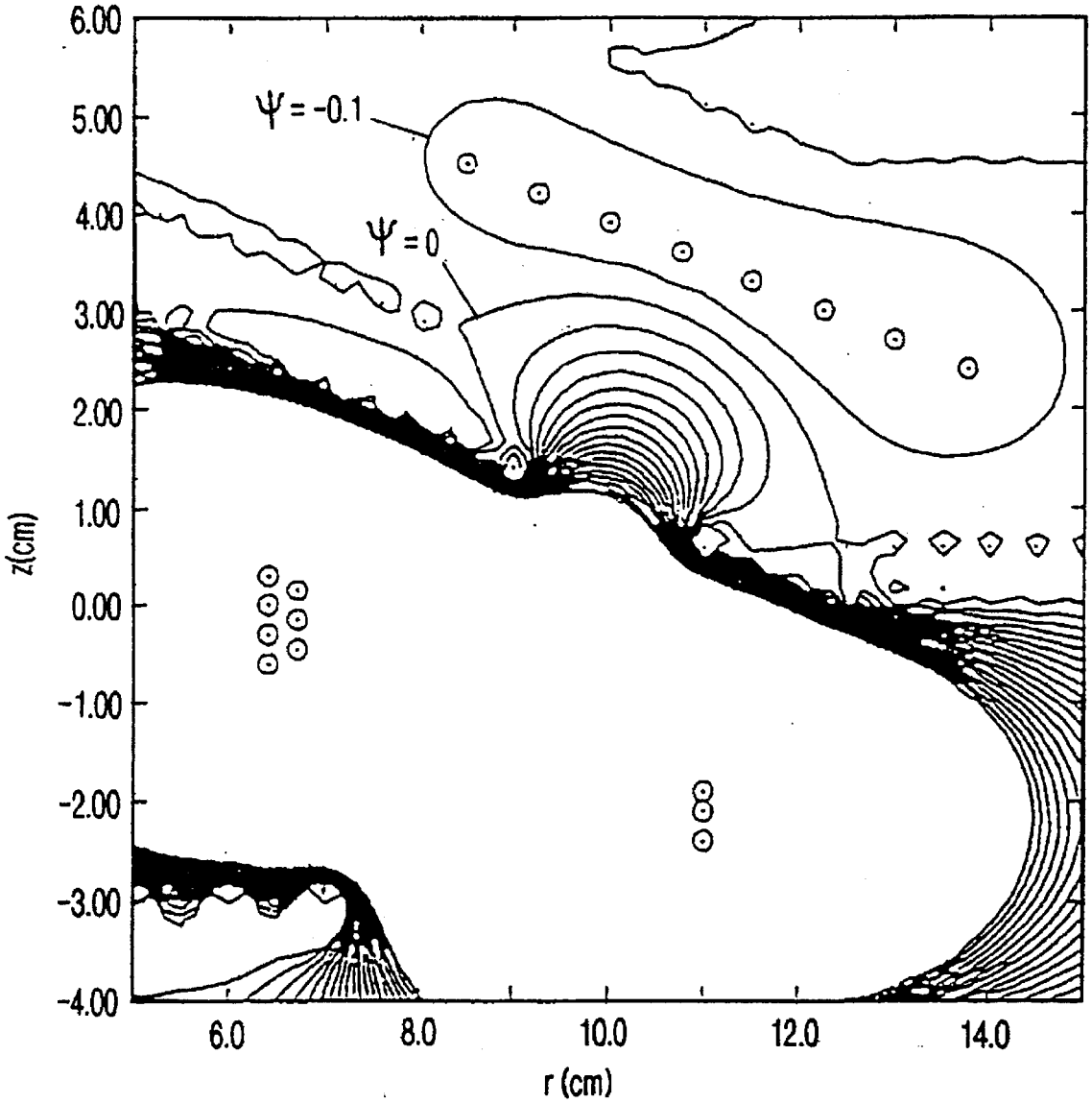
Figure 2H:
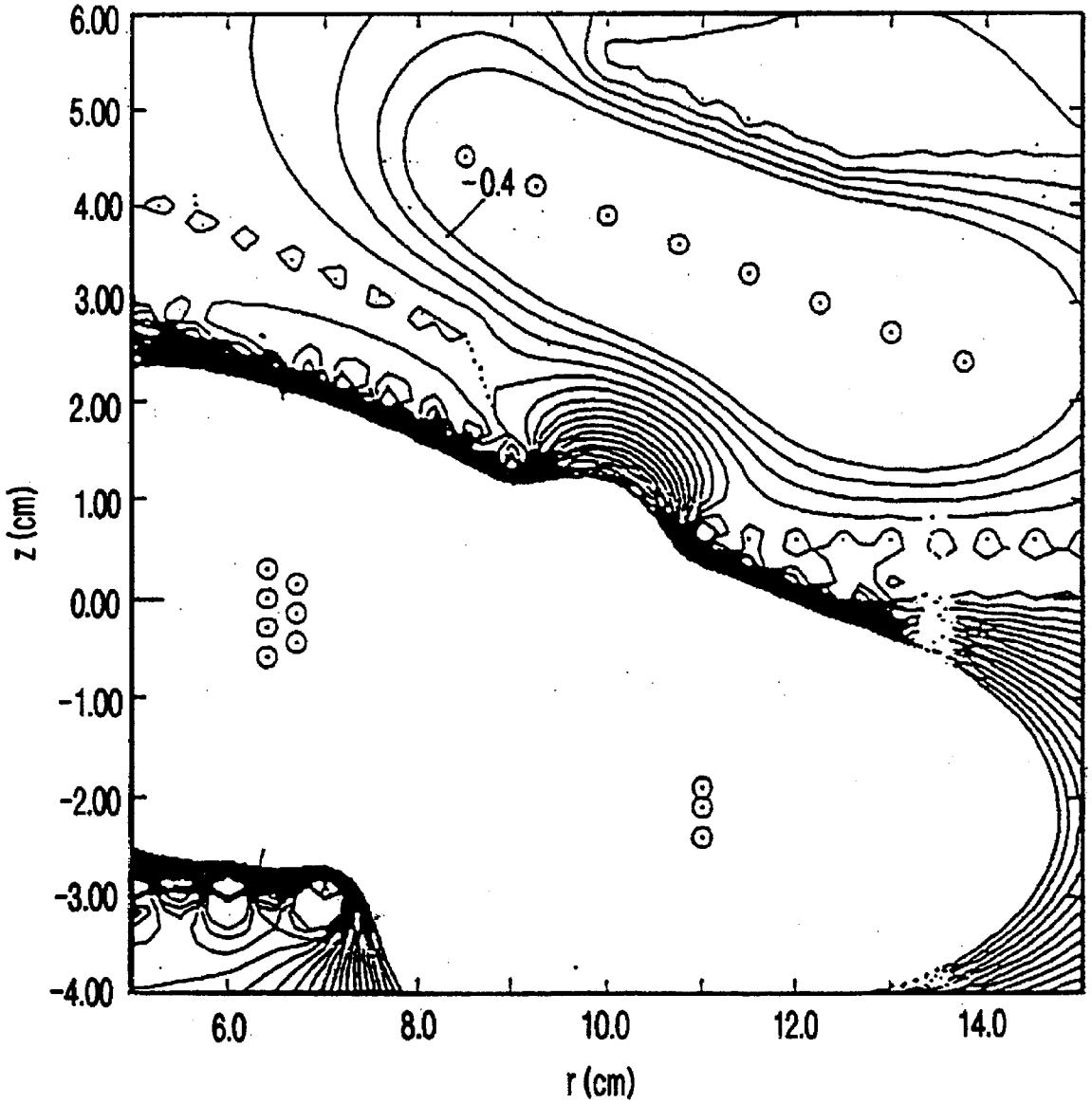

Returning to FIG. 2A, if the gas broke down immediately with firing the fast coil and the resulting plasma was instantly tied to the flux surface just in front of the fast coil (where $\Psi$=0.2), then when $I_{fc}$ goes to 1, the plasma would actually be out past the anode annulus (still on the $\Psi$=0.2 flux surface). But, since breakdown and rise of conductivity of the plasma to the point of being tied to flux surfaces requires some finite time, the flux 'leaks' through the ionization region. For example, the $\Psi$=0 surface sweeps out to about 5 mm in front of the fast coil surface by the time $I_{fc}$=0.02 as seen in FIG. 2G. Therefor, if the plasma at this location is not already magnetized by this time, it will not reach the anode location when $I_{fc}$32 1. The longer it takes to catch the plasma on the field, the further back behind the anode annulus it will be sitting when $I_{fc}$ =1.

One of the advances we have made is to correct for this lag time by initially reverse biasing the fast coil. If one starts with a reverse bias field made by $I_{fc}$=−0.05 as shown in FIG. 2F, then, first, when one fires the fast coil driver, the Ψ value is about 1 just in front of the fast coil, so one has more time until the Ψ=0 surface sweeps past than in the case without the reverse bias fast coil field (FIG. 2A). Second, and perhaps more importantly, one has the B field null 28, where the breakdown is enhanced because electrons are not magnetized. This allows them to freely accelerate in the inductive E field and ionize the gas more effectively. Third, this x-point null sits about halfway between the fast coil surface and the anode annulus. When the fast coil driver is fired and the current rises, the Ψ=0 surface sweeps past this point at about $I_{fc}$=0.08+0.05=0.13. Thus, using reverse bias, we have a substantially longer time to break down the gas and still be able to catch the plasma on the Ψ=0 surface.

Other factors enter into the optimization. First, the plasma will never be perfectly tied to flux surfaces and will continue to diffuse across the field throughout the process to some extent. This is part of the reason the fast coil driver is made so fast. Second, the plasma is always free to move along the flux surface. It will move toward a weaker field, so one needs to try to prevent it from 'squirting' out of the ionization region by careful design of the flux excluders of the anode assembly. The goal is to compress the B field between the fast coil and the excluder to keep it from falling off too fast with radius in view of the 1/r dependence of field strength because of the parallel flux surfaces.

It is also possible to operate the MAP by beginning the fast coil pulse before the gas from the puff valve reaches entirely across the fast coil location. In this case, ionization of the gas is done primarily at the small radius region (r=6–10 cm) of the ion beam source and is then guided along magnetic field lines and also pushed by them as the field increases.

Figure 3:
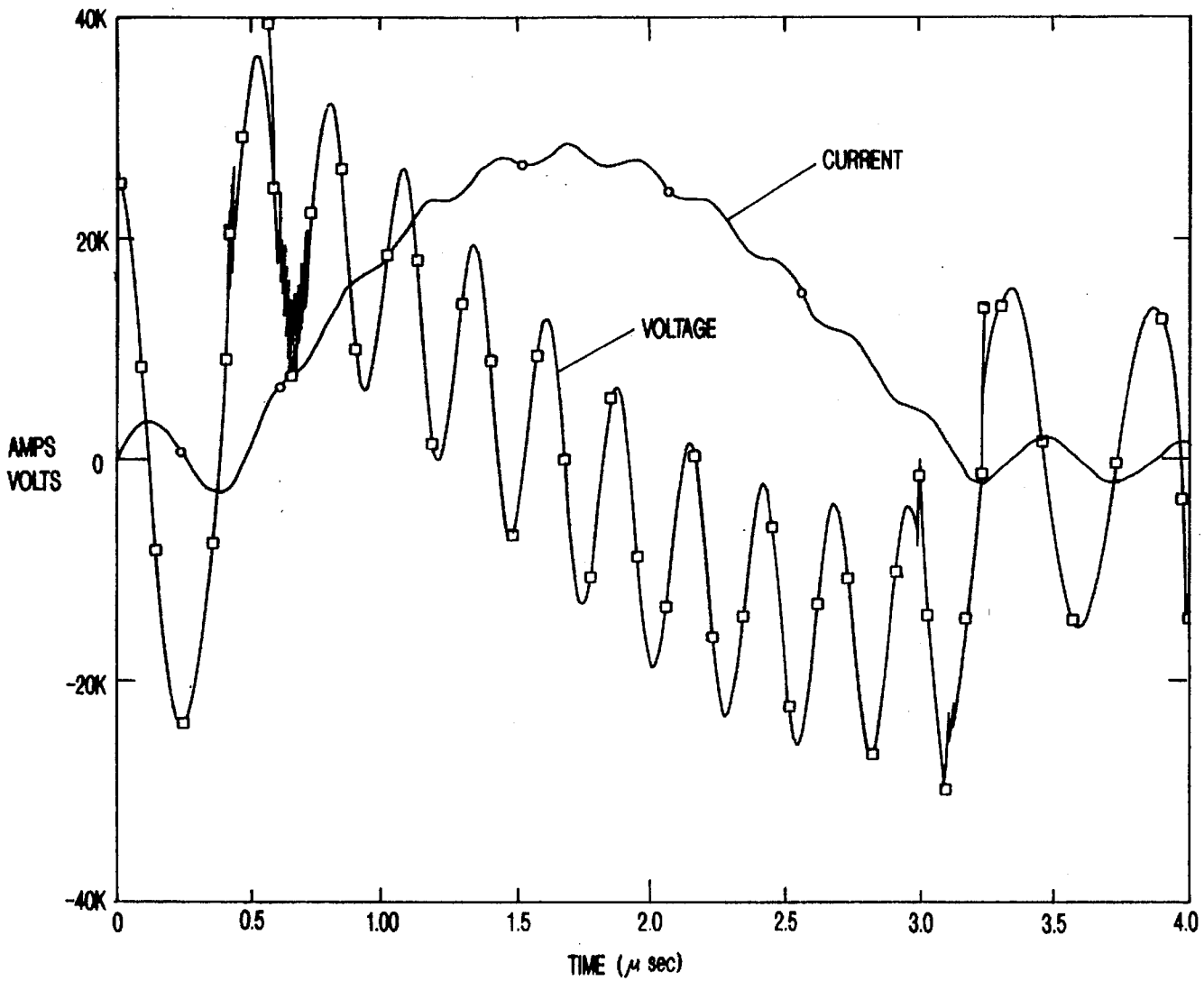
FIG. 3 is a graph showing the fast coil current and voltage with the ringing circuit to pre-ionize and ionize the gas in front of the fast coil but without the initial negative bias.
Figure 4:
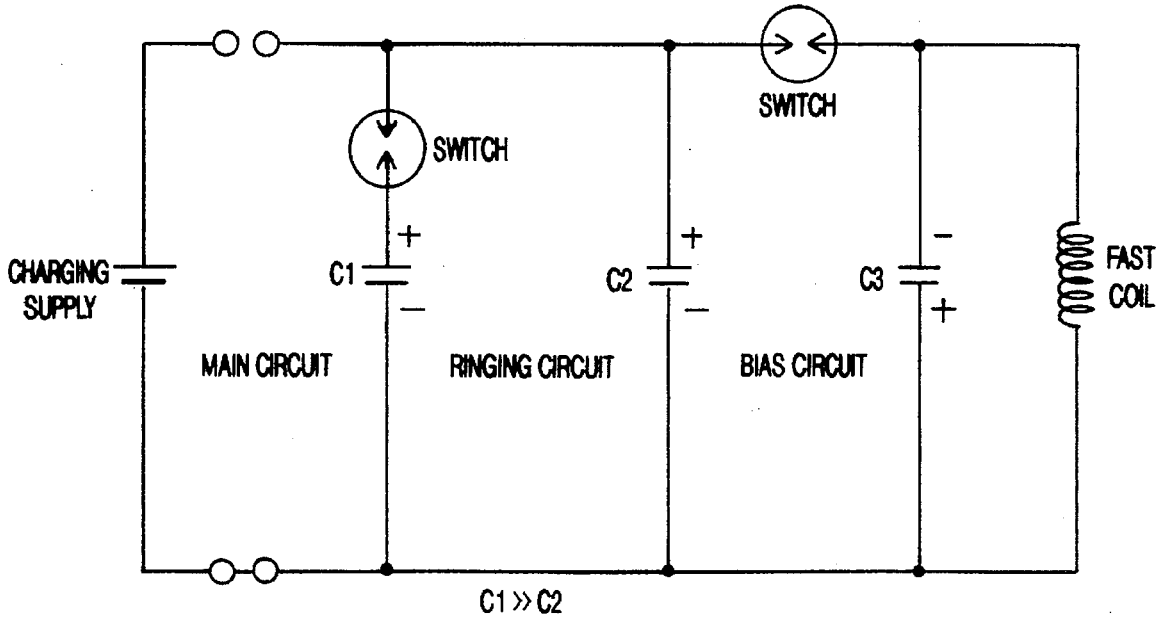
FIG. 4 is a schematic electrical diagram of a ringing circuit to drive the fast coil.

Returning again to the ringing circuit discussion, one can now understand how the known ringing circuit concept can be combined with the initial negative biasing of the fast coil to improve the effectiveness of the pre-ionization of the gas in the ion beam source. This combination is realized in the driving circuit shown in FIG. 3. The waveforms produced by this circuit (without negative bias current) are shown in FIG. 4. Note in FIG. 4 how the current takes an initial negative excursion down through zero prior to rising again through zero on its way up into the main ringing signal for the fast coil. The effect on fast coil voltage is also shown.

It is possible to increase the ionization efficiency of the ion beam source in other ways as well. One can also employ an externally driven electrical circuit driving an ionization assistor means that would provide photons and/or plasma to the gas separately and apart from the techniques discussed above. This could be done by using a spark source to provide ultraviolet photons to the gas either on the upstream side of the outer anode flux excluder or, at a smaller radius, in the passageway downstream from the puff valve. Other examples of pre-ionization assistor means include a microwave or RF source or a capacitively or inductively coupled system that induces ionization in the gas or produces an arc on surfaces that also ionizes the gas. Additionally, one can use combinations of different gases to make it easier to ionize the gas mixture with any of these ionization techniques. For example, either helium or argon (easily ionizable gases) may be mixed with hydrogen (a difficult to ionize gas) to facilitate the ionization of the hydrogen. The helium or argon ionizes first and then greatly increases the efficiency of the hydrogen ionization. By tailoring the ratios of the various gases, one can also tailor the deposition lengths of the constituents in the resulting beams in the target material and the resulting local heating effects in the material.

We have also discovered that the flux excluder structures of the anode assembly can be improved by using materials other than the aluminum used in the past. Multilayered structures are beneficial in this regard. The use of multilayered anode flux excluder structures provides several advantages in MAP ion beam sources. The problem of energy deposition on the cathode side of the anode flux excluder is reduced by the ability to use damage resistant, high melting point materials such as carbon, tungsten, molybdenum and titanium to absorb energy deposited by electrons emitted form the cathode without loss of material. This can be accomplished by using materials that combine high melting and/or vapor points with relatively low electrical conductivity as a layer 51 facing the slow coil. The low conductivity allows partial penetration of magnetic field from the cathode magnetic field coils, spreading the region over which the electrons strike the anode flux excluder, region 1 in FIG. 5, and thus reducing the local energy density and the tendency toward surface damage.

Because MAP ion beam source operation requires control of the penetration of the magnetic field produced by the relatively slow (typically 100 microsecond rise time) cathode magnetic field coils, it is useful to include a layer 53 of some good electrical conductor (Cu or Al) in the anode flux excluder structure. The good conductor provides flux surface shaping and control of the penetration of the cathode magnetic field by resisting penetration.

The fast magnetic field coil side of the anode flux excluder can also be made more resistant to damage by the use of a layer of damage resistant, low electrical conductivity material to allow partial penetration of the fast coil side anode flux excluder layer 52 by the fast (typically 1 microsecond rise time) magnetic field. This penetration spreads the area (the region of the anode flux excluder 50 adjacent the plasma region shown in FIG. 5) over which the plasma contacts the anode flux excluder, thus reducing the local current density and damage at the point of contact. In contrast, prior art structures have used only a good conductor, typically aluminum, as a single layer flux excluder with the detrimental effect that the contact region of the flux excluder to the plasma is squeezed into a much smaller area resulting in much high local current density and concomitant damage.

Figure 5:
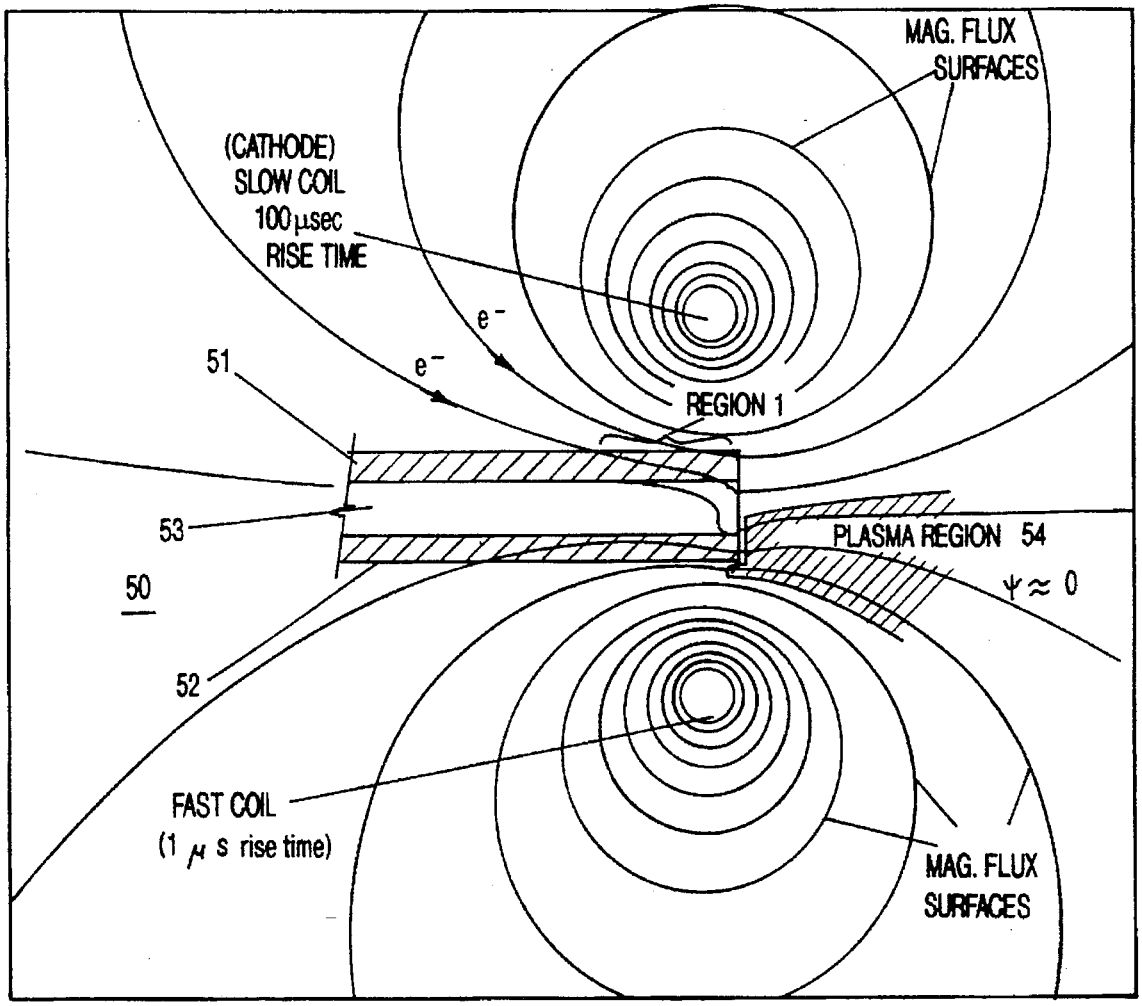
FIG. 5 is a cross sectional diagram of one of the anode excluder tips adjacent the anode annulus showing the improved layered structure and its resulting effect on the magnetic flux surface lines.

FIG. 5 shows one embodiment of this technique. A two dimensional magnetic field diffusion code was used to calculate the effect of a multilayered carbon (1 mm)—copper (2 mm)—carbon (1 mm) anode flux excluder structure 50 on the magnetic field profiles and the resulting areas (region 1) over which electrons from the cathode would strike the anode flux excluder and the current contact area between the MAP-produced anode plasma 54 and the anode flux excluder. Both the slow and fast magnetic fields produced by the cathode and fast coils respectively penetrate the relatively low electrical conductivity carbon layers 51 and 52 on each side of the flux excluder. The highly conductive copper layer 53 does shape the cathode magnetic field, preventing it from penetrating into the fast coil side of the flux excluder but also undergoes partial penetration itself, contributing to the spread of the contact areas in region 1 and the region of the flux excluder contacting the plasma. Other configurations of multilayered materials with different electrical and thermal conductivity's and damage resistance properties will be broadly useful in field shaping and damage and debris reduction in MAP and other beam systems requiring field shaping in high energy density environments.

As was noted above, the MAP ion beam source is intended for use primarily in continuous production environments. This requires the use of means by which heat arising from either electric energy, created by either direct or induced currents, or beam energy deposited in components can be removed. This can be achieved by a variety of standard techniques including the use of fluid coolants to remove heat from the components, by the use of thermal conduction and high heat capacity elements to conduct the heat away, or by a combination of these techniques. These techniques are applicable to all MAP components including, but not limited to, the cathode, anode flux excluder, fast coil, puff valve, and all field coils and electrical systems powering MAP components. Also, all components that are exposed to plasmas, beams, or high induced fields should be provided with damage resistant surfaces. These are the same type of materials that were discussed above for the outer layers of the anode flux excluders, namely, high melting and vapor point, high specific heat, or high thermal conductivity materials or materials having combinations of these properties. In some cases it will be necessary to combine damage resistance with mechanisms to remove heat as discusses above. It is also desirable to include a variety of standard switching techniques to recapture undissipated electrical energy not used in the actual pulse in order that heat load on the system and recharge energy needed for the next pulse can both be reduced.

I claim:

1. A pulsed ion beam source comprising:

an anode assembly disposed in a radially symmetric manner about a central axis that defines the axis of beam propagation from the pulsed ion beam source, the anode assembly being separated by an annulus between inner and outer anode subassemblies;

a gas supply means comprising puff valve means located on the central axis and behind the anode assembly and a radially extending gas supply passage that extends from the puff valve means to a gas ionization zone located to the rear of the anode annulus, the zone being enclosed to the rear by a structure in which is contained fast coil means;

a cathode assembly disposed in a radially symmetric manner about the central axis and forward from the anode assembly, the cathode assembly being separated by a cathode annulus between inner and outer cathode subassemblies, the anode and cathode assemblies being separated by an accelerating gap;

slow coil means located within the inner and outer cathode subassemblies;

means to deliver a power pulse to the anode assembly to accelerate ions, created from a gaseous substance delivered to the ionization zone and ionized by the fast coil means, forward through the accelerating gap and out through the cathode annulus; and means to ionize the gaseous substance into a plasma and to deliver the plasma to the anode annulus prior to the delivery of the power pulse comprising ringing circuit means to impose a rapidly oscillating signal on a main signal delivered to the fast coil means and to initially reverse bias current through the fast coil means which current is then returned to the normal polarity by the main fast coil pulse as it is delivered to the fast coil means.

2. The ion beam source of claim 1 wherein the inner and outer anode subassemblies are configured as flux excluders such that the ends of the inner and outer anode subassemblies adjacent the anode annulus comprise a first layer facing the fast coil means comprising a relatively low electrical conductivity and high melting and vapor point material, a middle layer comprising a high electrical conductivity material and a third layer facing the accelerating gap comprising a relatively low electrical conductivity and high melting and vapor point material.

3. The ion beam source of claim 2 wherein the first and second layers are selected from the group consisting of carbon, tungsten, molybdenum and titanium.

4. The ion beam source of claim 2 wherein the first and second layers are selected from the group consisting of copper, silver, gold and aluminum.

5. The ion beam source of claim 1 wherein the gaseous substance delivered to the ionization zone is selected from the group consisting of gases and vaporizable liquids and solids.

6. The ion beam source of claim 1 additionally comprising means to introduce plasma into the ionization region that are created outside of the ionization region.

7. The ion beam source of claim 6 wherein the means to introduce plasma is selected from the group consisting of RF source means, microwave source means, capacitively coupled electric field source means and inductively coupled electric field source means.

8. A pulsed ion beam source comprising:

an anode assembly disposed in a radially symmetric manner about a central axis that defines the axis of beam propagation from the pulsed ion beam source, the anode assembly being separated by an annulus between inner and outer anode subassemblies;

a gas supply means comprising puff valve means located on the central axis and behind the anode assembly and a radially extending gas supply passage that extends from the puff valve means to a gas ionization zone located to the rear of the anode annulus, the zone being enclosed to the rear by a structure in which is contained fast coil means;

a cathode assembly disposed in a radially symmetric manner about the central axis and forward from the anode assembly, the cathode assembly being separated by a cathode annulus between inner and outer cathode subassemblies, the anode and cathode assemblies being separated by an accelerating gap;

slow coil means located within the inner and outer cathode subassemblies;

means to deliver a power pulse to the anode assembly to accelerate ions, created from a gaseous substance delivered to the ionization zone and ionized by the fast coil means, forward through the accelerating gap and out through the cathode annulus; and means to ionize the gaseous substance into a plasma comprising means to create nulls in the magnetic field present in the ionization zone.

9. The ion beam source of claim 8 wherein the means to create nulls comprises a bias circuit means that initially provides a negative bias current to the fast coil means.

10. The ion beam source of claim 8 wherein the means to create nulls further comprises ringing circuit means that provides a rapidly oscillating current at least 5% of the strength of a main ionization current pulse also provided to the fast coil means.

* * * * *